US006058627A

United States Patent [19]

Violette et al.

[11] Patent Number: 6,058,627

[45] **Date of Patent: *May 9, 2000**

[54] ALL-TERRAIN FOOTWEAR WITH RETRACTABLE SPIKES

[76] Inventors: Richard R. Violette, Rte. 10, Box 1242, Old Belgrade Rd.; Joyce V. Sawtelle, Box 899, Old Belgrade Rd., both of Augusta, Me. 04330

[ * ] Notice: This patent issued on a continued prosecution application filed under 37 CFR 1.53(d), and is subject to the twenty year patent term provisions of 35 U.S.C. 154(a)(2).

[21] Appl. No.: 09/233,735

[22] Filed: Jan. 20, 1999

[51] Int. Cl.[7] ..... A43C 15/02

[52] U.S. Cl. ..... 36/61; 36/59 R

[58] Field of Search ..... 36/61, 59 R, 59 C

[56] References Cited

U.S. PATENT DOCUMENTS

| | | | |
|---|---|---|---|
| 48,943 | 7/1865 | Hodgins . | |
| 919,082 | 4/1909 | Schaney . | |
| 1,662,111 | 3/1928 | Halstead . | |
| 3,693,269 | 9/1972 | Guarrera . | |
| 3,716,931 | 2/1973 | Loudermilk | 36/61 |
| 3,793,751 | 2/1974 | Gordos | 36/61 |
| 4,375,729 | 3/1983 | Buchanen, III | 36/61 |
| 4,507,879 | 4/1985 | Dassler . | |
| 4,779,361 | 10/1988 | Kinsaul . | |
| 4,821,434 | 4/1989 | Chein | 36/134 |
| 4,825,562 | 5/1989 | Chuang | 36/61 |
| 4,873,774 | 10/1989 | Lafever | 36/61 |
| 4,914,838 | 4/1990 | Ihlenburg . | |
| 5,269,080 | 12/1993 | Davis | 36/134 |
| 5,289,647 | 3/1994 | Mercer | 36/134 |
| 5,299,369 | 4/1994 | Goldman | 36/61 |
| 5,337,494 | 8/1994 | Ricker | 36/61 |
| 5,497,565 | 3/1996 | Balgin | 36/61 |
| 5,526,589 | 6/1996 | Jordan | 36/134 |
| 5,732,482 | 3/1998 | Remington et al. | 36/61 |
| 5,737,855 | 4/1998 | Jordan et al. | 36/61 |

FOREIGN PATENT DOCUMENTS

| | | |
|---|---|---|
| 16118374 | 1/1991 | U.S.S.R. . |

*Primary Examiner*—Ted Kavanaugh
*Attorney, Agent, or Firm*—Pierce Atwood; Patrick R. Scanlon

[57] ABSTRACT

An article of footwear includes a sole having a cavity formed therein and a plurality of holes extending from the cavity to the bottom surface of the sole. A spike is disposed in each one of the holes, and each spike is translatable between an extended position wherein a first end of the spike protrudes from the bottom surface of the sole and a retracted position wherein the first end does not protrude from the bottom surface of the sole. A slide member is slidably disposed in the cavity and has a plurality of recesses formed in a first surface thereof which is oriented towards the spikes. The slide member is translatable in a lengthwise direction between a first position wherein the recesses are aligned with the spikes so that the spikes assume their retracted position and a second position wherein the recesses are not aligned with the spikes so that the spikes assume their extended position.

13 Claims, 4 Drawing Sheets

ALL-TERRAIN FOOTWEAR WITH RETRACTABLE SPIKES

BACKGROUND OF THE INVENTION

This invention relates generally to footwear and more particularly to a sole for footwear having spikes that are easily retracted and extended.

The provision of spikes or cleats or the like to footwear has useful application in many situations. Spiked shoes or boots are used to improve footing on surfaces made slippery by ice, snow or other bad weather conditions as well as on difficult terrain such as steep slopes. Spiked footwear is also used in many athletic activities such as golf, baseball, hiking, rock climbing and so on. While useful in enhancing traction in a variety of situations, conventional spiked footwear has a disadvantage in that the spikes cannot be removed when the wearer moves onto other surfaces. Since the spikes are attached to the bottom of the sole, they are in constant contact with the surface being walked upon, even for surfaces that do not require the improved traction provided by the spikes. In the case of hard surfaces such as certain floors, parking lots, sidewalks, etc., this causes excessive wear of the spikes requiring frequent replacement. Furthermore, the exposed spikes can cause substantial damage to delicate surfaces such as wood floors, carpeting and putting greens of golf courses.

In response to this dilemma, many shoes having spikes that can be extended when needed and retracted when walking on hard and/or easily damaged surfaces have been proposed. However, many of these shoes provide complicated mechanisms for extending and retracting the spikes. Such mechanisms tend to be relatively expensive, susceptible to failure and bulky. Many prior art designs use hand operated controls located somewhere on the shoe requiring the wearer to bend over, or even take the shoe off, in order to retract or extend the spikes.

Accordingly, there is a need for all-terrain footwear that not only can be worn on surfaces where enhanced traction is needed, but can be worn on hard or easily damaged surfaces where enhanced traction is not needed. There is a further need for such footwear having spikes that can be easily extended or retracted without having to bend over to manipulate a knob or lever on the footwear. There is also a need for a retractable spike system that does not require a complicated and/or expensive mechanism to control the spikes.

SUMMARY OF THE INVENTION

The above-mentioned needs are met by the present invention which provides an article of footwear having a sole with a cavity formed therein and a plurality of holes extending from the cavity to the bottom surface of the sole. A spike is disposed in each one of the holes, and each spike is translatable between an extended position wherein a first end of the spike protrudes from the bottom surface of the sole and a retracted position wherein the first end does not protrude from the bottom surface of the sole. A slide member is slidably disposed in the cavity and has a plurality of recesses formed in a first surface thereof which is oriented towards the spikes. The slide member is translatable in a lengthwise direction between a first position wherein the recesses are aligned with the spikes so that the spikes assume their retracted position and a second position wherein the recesses are not aligned with the spikes so that the spikes assume their extended position.

In a preferred embodiment, the slide member includes a front tab that protrudes from the front end of the footwear when the slide member is located toward the front of the cavity and a back tab that protrudes from the back end of the footwear when the slide member is located toward the back of the cavity. The slide member can be moved between its first and second positions by applying force to the front or back tab. The footwear can be configured such that the first position of the slide member is toward the back of the cavity, or such that the first position of the slide member is toward the front of the cavity.

This arrangement provides a retractable spike system that is simple and easy to operate, is durable, and does not use a complicated and expensive mechanism. The spikes are interchangeable, and the system includes means that resist inadvertent retraction or extension of the spikes. Other objects and advantages of the present invention will become apparent upon reading the following detailed description and the appended claims with reference to the accompanying drawings.

DESCRIPTION OF THE DRAWINGS

The subject matter which is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
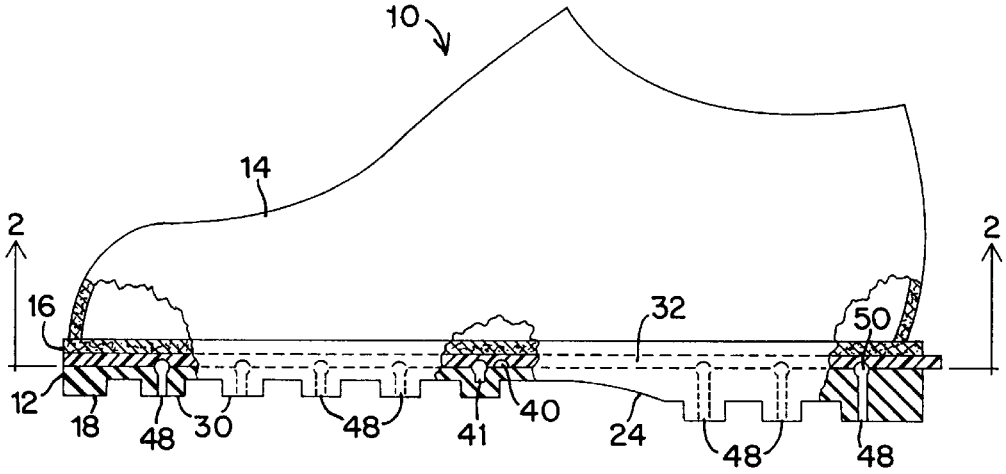
FIG. 1 is a partially cutaway side view of the footwear of the present invention with spikes in a retracted position.
Figure 2:
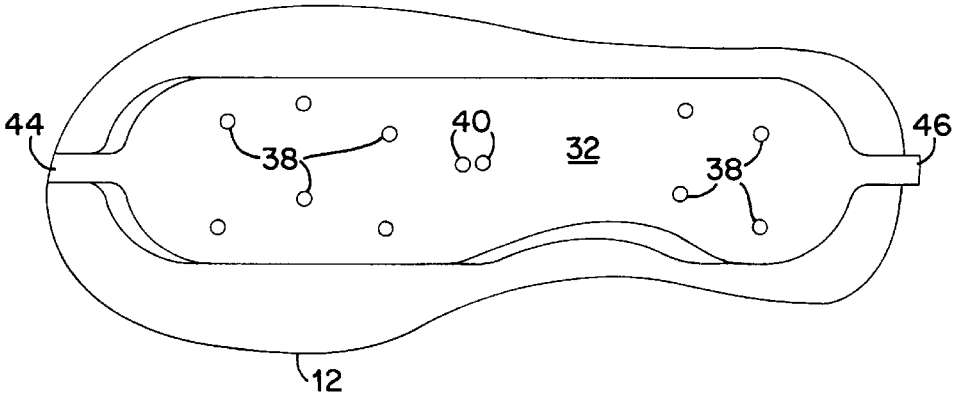
FIG. 2 is a sectional view of the footwear shown in FIG. 1 and taken generally along the line 2—2.

Referring to the drawings wherein identical reference numerals denote the same elements throughout the various views, FIGS. 1–4 show a shoe 10 having a sole 12 and a shoe upper 14 connected to the sole 12 by any suitable means known in the art, such as stitching or heat sealing. While the Figures show a shoe, it should be noted that the present invention is not limited to use with just shoes, but is applicable to many types of footwear including, but not necessarily limited to, walking shoes, golf shoes, athletic shoes, boots, clogs, sneakers and so on. Furthermore, the terms "upper," "lower," "downward" and "bottom" shall relate to the footwear as oriented in FIGS. 1 and 3, although it is understood that the footwear may assume various other orientations while being used. In addition, as used herein, the term "front" shall relate to the toe area of the footwear, and the term "back" shall relate to the heel area of the footwear.

Figure 3:
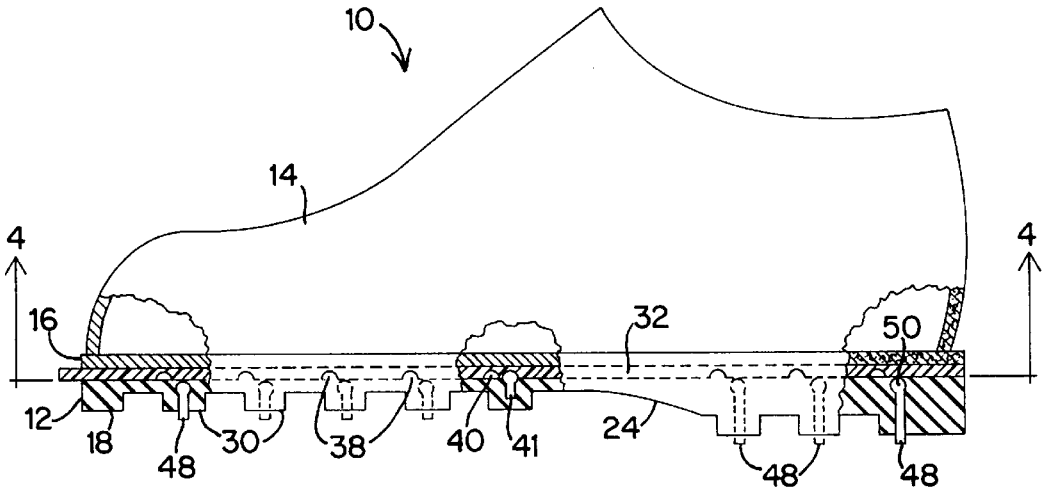
FIG. 3 is a partially cutaway side view of the footwear of the present invention with spikes in an extended position.
Figure 4:
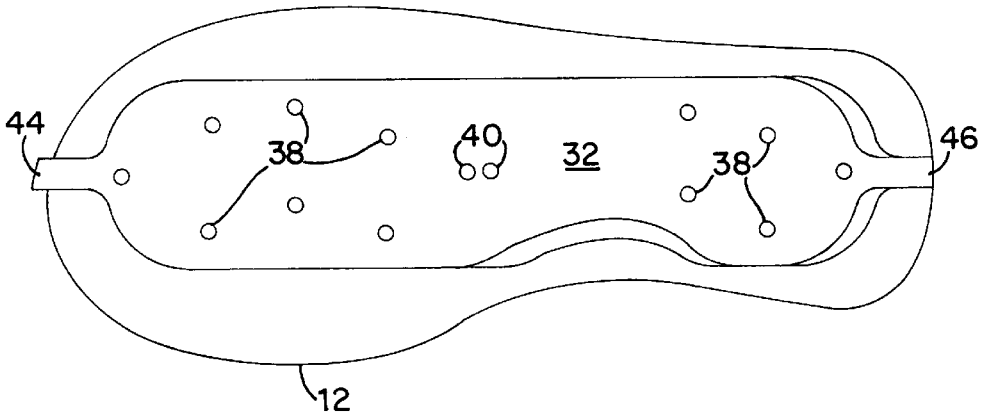
FIG. 4 is a sectional view of the footwear shown in FIG. 3 and taken generally along the line 4—4.
Figure 5:
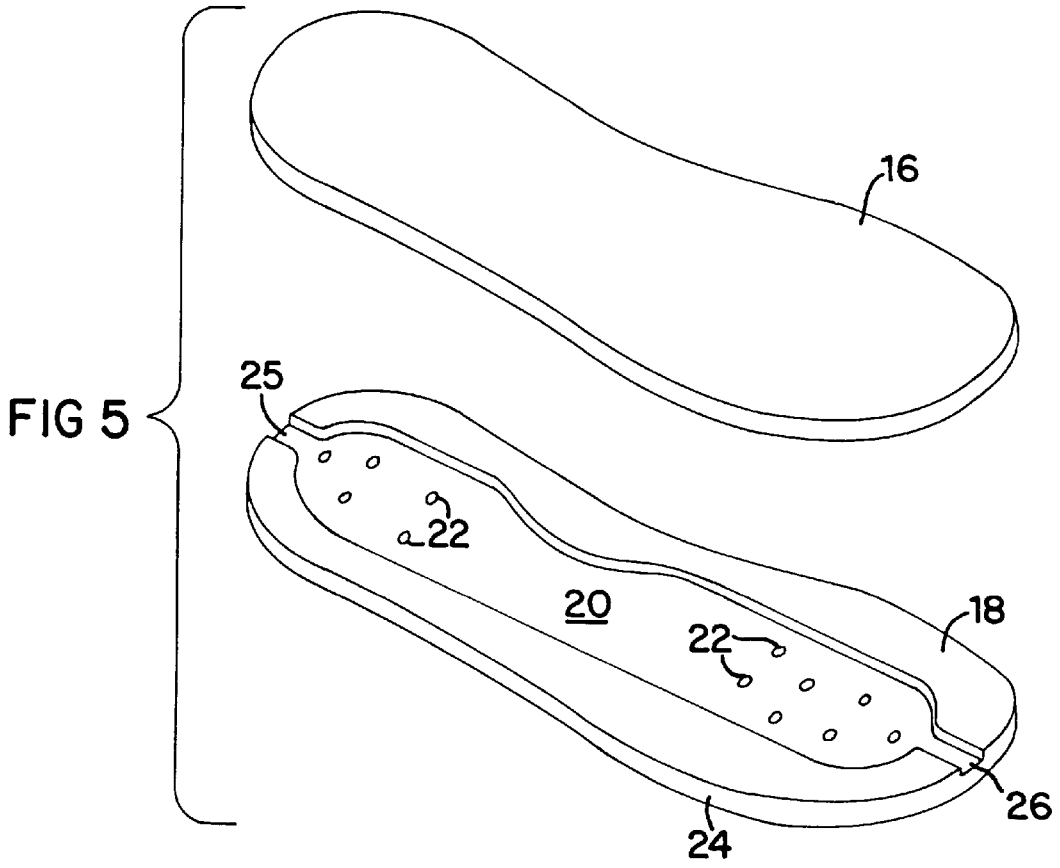
FIG. 5 is an exploded perspective view of a sole in accordance with the present invention.

The sole 12 is a two-part piece having an upper portion 16 and a lower portion 18. As best shown in FIG. 5, the lower portion 18 has a cavity 20 formed therein. The cavity 20 is an elongated cavity extending lengthwise with respect to the sole 12 from a point adjacent to the front end of the sole 12 to a point adjacent to the back end of the sole 12. A plurality of small holes 22 is formed in the lower portion 18. The holes 22 are open-ended bores that extend from the cavity 20 to the bottom surface 24 of the lower portion 18. The lower portion 18 also includes a front channel 26 extending from the cavity 20 to the front end of the lower portion 18, and a back channel 28 extending from the cavity 20 to the back end of the lower portion 18. The upper portion 16 and the lower portion 18 are bonded together by any suitable means such as heat sealing, adhesive or the like. The bottom surface 24 of sole 12 may be provided with treads 30 as shown in FIGS. 1 and 3, although the present invention can also be used with smooth-soled footwear as well.

A slide member 32 is slidably disposed in the cavity 20. The slide member 32 is a thin, elongated piece made out of a sturdy, but somewhat flexible, material such as plastic and has a similar geometry to the cavity 20. Specifically, the slide member 32 has a width that is substantially the same as the width of the cavity 20 and a length that is slightly less than the cavity's length. Thus, the slide member 32 is translatable in a lengthwise direction with respect to the sole 12. That is, the slide member 32 can be moved back-and-forth between a first position abutting the back of the cavity 12 (shown in FIGS. 1 and 2) and a second position abutting the front of the cavity 12 (shown in FIGS. 3 and 4).

The slide member 32 has a first or bottom surface 34 and a second or upper surface 36. A plurality of recesses 38 is formed in the first surface 34. The number of recesses 38 is equal to the number of holes 22 formed in the lower portion 18 of the sole 12, and the recesses 38 and the holes 22 are laid out in the same configuration, preferably with some grouped in the portion of the sole 12 that corresponds to the ball of the foot and some grouped in the portion of the sole 12 that corresponds to the heel. A pair of notches 40 is also formed in the first surface 34 of the slide member 32. The notches 40 are preferably located in the center region of the slide member 32. A lock pin 41 (shown in FIGS. 1 and 3) is fixed in the lower portion 18 of the sole 12 so as to have a portion extending into the cavity 20. The lock pin 41 is positioned so as to be aligned with the forward one of the notches 40 when the slide member 32 is in the first position, and aligned with the back notch when the slide member 32 is in the second position. The notches 40 and lock pin 41 thus function as a detent for preventing the slide member 32 from inadvertently moving from one position to another. Alternatively, the lock pin 41 could be fixed in the first surface 34 of the slide member 32, and the notches 40 could be formed in the sole 12.

Figure 6:
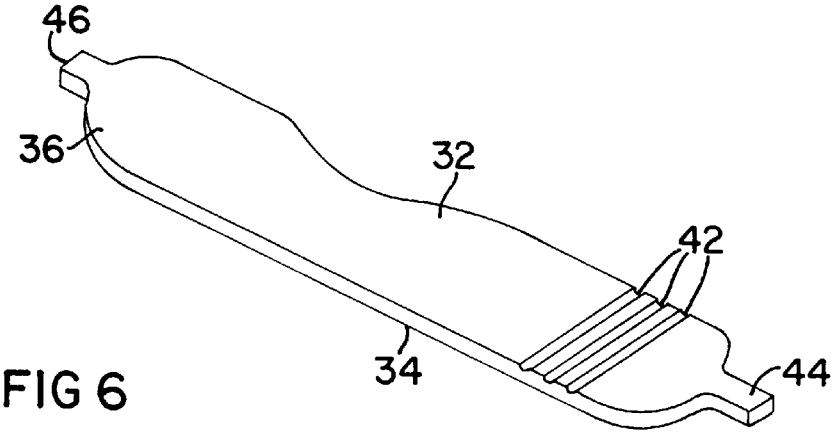
FIG. 6 is a perspective view of a slide member in accordance with the present invention.

As best shown in FIG. 6, the second surface 36 of the slide member 32 has a plurality of grooves 42 formed therein. The grooves 42 extend laterally across the slide member 32 and are located in an area of the slide member that corresponds to the ball of the foot. Thus, the grooves 42 will enhance the flexibility of the slide member 32 at the location that undergoes the most bending during use.

The slide member 32 also has a front tab 44 formed on the front thereof and a back tab 46 formed on the back thereof. The front and back tabs 44,46 are positioned and sized so as to fit into the front and back channels 26,28, respectively. The tabs 44,46 are of such a length so that when the slide member 32 is in its first position abutting the back of the cavity 20, the back tab 46 protrudes slightly from the back end of the sole 12 and the front tab 44 does not protrude from the front end of the sole 12. And when the slide member 32 is in its second position abutting the front of the cavity 20, the front tab 44 protrudes slightly from the front end, and the back tab 46 does not protrude from the back end.

The shoe 10 further includes a plurality of spikes 48, each one of which is disposed in a respective one of the holes 22 formed in the bottom portion 18 of the sole 12. As used herein, the term "spikes" is intended to include studs, cleats and other ground-engaging members. The spikes 48 are translatable along their respective longitudinal axes and in their respective holes 22 between an extended position wherein a first end of each spike 48 protrudes from the bottom surface 24 of the sole 12 and a retracted position wherein the first end does not extend beyond the bottom surface 24. The second end of each spike 48 is in direct contact with the first surface 34 of the slide member 32 and preferably has an enlarged head 50 formed thereon. As mentioned above, the recesses 38 in the first surface 34 of the slide member 32 and the holes 22 (and hence the spikes 48) are laid out in the same configuration. More specifically, the recesses 38 are positioned on the slide member 32 in such a manner that they are aligned with the spikes 48 when the slide member 32 is in its first position, and they are not aligned with the spikes 48 when the slide member 32 is in its second position. When the recesses 38 and spikes 48 are aligned, the spike heads 50 can be received in the recesses 38 so that the spikes 48 assume their retracted position. When the recesses 38 and spikes 48 are not aligned, the spikes 48 are forced downward by the first surface 34 into their extended position.

Figure 7:
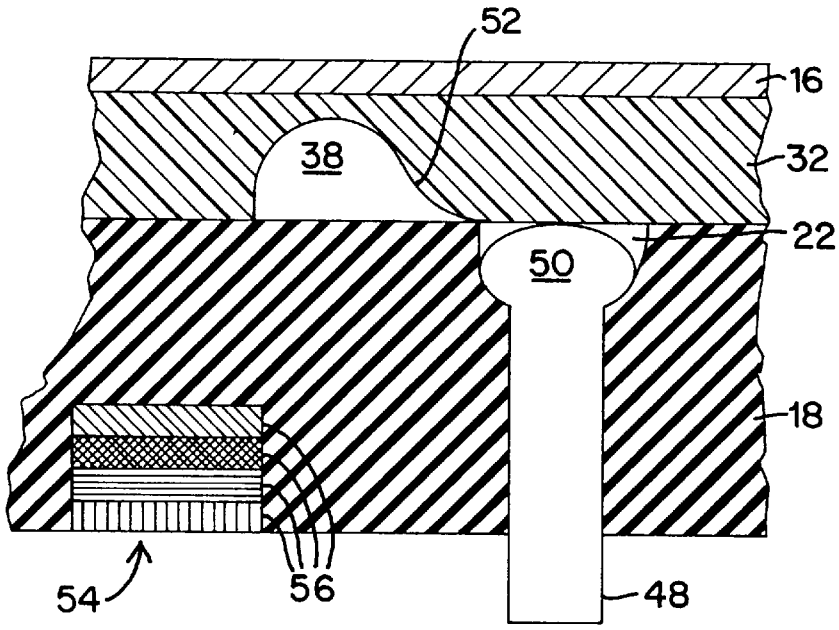
FIG. 7 is an enlarged partial sectional view of a sole in accordance with the present invention showing an extended spike and a wear indicator.
Figure 8:
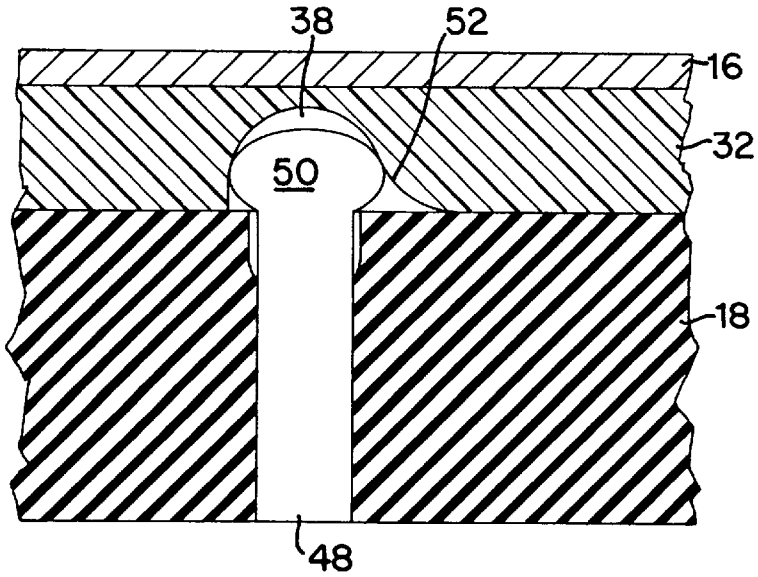
FIG. 8 is an enlarged partial sectional view of a sole in accordance with the present invention showing a retracted spike.

Turning to FIGS. 7 and 8, a feature of the present invention that is most applicable when the sole 12 is made of a resilient material such as rubber is shown. That feature is providing the spike heads 50 with a ball-shaped geometry having a cross-sectional area that is slightly larger than the cross-sectional area of the holes 22. Thus, when the slide member 32 is positioned to force the spikes 48 into their extended position (FIG. 7), the resiliency of the sole material allows the hole 22 to expand in order to receive the head 50, particularly under the weight of the person wearing the shoe 10. But when the slide member 32 is positioned so that the recesses 38 are aligned with the spikes 48 (FIG. 8), the downward force acting on the spikes 48 is removed and the resiliency of the sole material pushes the spikes 48 into their retracted position. Furthermore, the head 50 is not too large to prevent the spike 48 from being purposely removed when in need of replacement. That is, the resilient nature of the sole 12 would allow an extended spike 48 to be gripped by a tool, such as a specially designed pair of pliers, and pulled out of the hole 22 through the bottom. On the other hand, the head 50 is large enough to prevent inadvertent spike removal due to the forces that the spikes 48 are subjected to during normal use. When the sole 12 is made of a less resilient material, such as leather, then the spike heads 50 would preferably be provided with a flat, circular geometry.

FIGS. 7 and 8 also illustrate how the recesses 38 are shaped to facilitate operation of the spikes 48. Specifically, the back sides 52 of the recesses 38 are provided with a gradual incline. Thus, when the slide member 32 is moved from its first position in the back of the cavity 20 to its second position in the front of the cavity 20, the back sides 52 act as cam surfaces that force the spikes 48 into their extended positions.

The present invention can further include a wear indicator 54 that is shown in FIG. 7. The wear indicator 54 comprises a stack of differently colored disks or inserts 56 embedded in the bottom surface 24 of the sole 12. The disks 56 are preferably made of the same material as the sole 12 or of a material that wears at the same rate as that of the sole 12. Thus, as the sole 12 is worn down over time, different colored disks 56 will be revealed. In this manner, the wear indicator 54 will provide an indication of when the spikes 48 are due for replacement.

To shift the spike position while wearing the shoe 10, i.e., to change the spikes 48 from their retracted position to the extended position, or vice versa, the wearer would have to cause the slide member 32 to shift position. For instance, if the spikes 48 were in the retracted position (slide member back), then the wearer of the shoe 10 would simply need to apply a force to the back tab 46 sufficient to overcome the detent action of the lock pin 41. To shift the spikes 48 back to their retracted position, the wearer would simply apply a similarly sufficient force to the front tab 44. Application of a sufficient force to the tabs 44,46 can be accomplished in any number of ways, such as kicking the appropriate tab against any convenient surface such as the ground or a curb. For convenience, a kick plate could be attached to the wall near entrances to houses or buildings. Furthermore, the wearer could carry a walking stick adapted to be used to strike the tabs 44,46 to effectuate retraction or extension of the spikes 48.

As described above, the shoe 10 of the present invention is configured so that the spikes 48 are retracted when the slide member 32 is in the first position (in the back of the cavity 20) and extended when the slide member 32 is in the second position (in the front of the cavity 20). In this manner, the front tab 44 protrudes when the spikes 48 are extended, but not when they are retracted. However, it is within the scope of the present invention to reverse this configuration so that the front tab 44 protrudes when the spikes 48 are retracted, but not when they are extended. Whichever configuration is used will not have a significant effect on the operation of the retractable spikes 48, but it is generally preferred to have the front tab 44 not protrude for the mode of use (either spikes retracted or spikes extended) which would be used most often. This would thereby minimize the chance of a protruding front tab 44 causing the wearer to stumble or trip. However, it is not anticipated that this will be a common occurrence in that the front tab 44 need not protrude very far beyond the tip of the sole 12.

The foregoing has described footwear having retractable spikes that are easily operated. While specific embodiments of the present invention have been described, it will be apparent to those skilled in the art that various modifications thereto can be made without departing from the spirit and scope of the invention as defined in the appended claims.

What is claimed is:

1. An article of footwear comprising:

a sole having a front end, a back end, a bottom surface, a cavity formed therein, a hole extending from said cavity to said bottom surface, a first channel extending from said cavity to said front end and a second channel extending from said cavity to said back end;

a traction improving spike having a first end and a second end, said spike being disposed in said hole and translatable along its longitudinal axis between an extended position wherein said first end protrudes from said bottom surface of said sole and a retracted position wherein said first end does not protrude from said bottom surface of said sole; and a slide member slidably disposed in said cavity and having a first surface oriented towards said spike, said slide member having a recess formed in said first surface and being translatable in a lengthwise direction with respect to said sole between a first position wherein said recess is aligned with said spike so that said spike assumes its retracted position and a second position wherein said recess is not aligned with said spike so that said spike assumes its extended position, said slide member further having a front tab received in said first channel and a back tab received in said second channel, wherein said front tab protrudes from said front end and said back tab does not protrude from said back end when said slide member is in one of its first and second positions and said back tab protrudes from said back end and said front tab does not protrude from said front end when said slide member is in the other of its first and second positions.

2. The footwear of claim 1 wherein said cavity extends lengthwise through said sole from a point adjacent said front end of said sole to a point adjacent said back end of said sole.

3. The footwear of claim 1 wherein said spike includes a head formed on said second end, said head having a cross-sectional area that is larger than the cross-sectional area of said hole.

4. The footwear of claim 3 wherein said sole is made of a resilient material so that said hole expands to receive said head when said spike is in its extended position and said spike is forced into its retracted position whenever said slide member is in its first position.

5. The footwear of claim 1 wherein said slide member is toward said back end of said sole when in its first position.

6. The footwear of claim 1 wherein said second end of said spike is in direct contact with said slide member.

7. The footwear of claim 1 wherein said slide member has a second surface opposite said first surface, said second surface having at least one groove formed therein.

8. The footwear of claim 7 wherein said groove extends laterally across said slide member.

9. The footwear of claim 1 further comprising a wear indicator disposed in said bottom surface of said sole.

10. The footwear of claim 9 wherein said wear indicator comprises a stack of differently colored disks embedded in said bottom surface of said sole.

11. The footwear of claim 1 wherein said sole has a plurality of holes extending from said cavity to said bottom surface and said slide member has a plurality of recesses formed in said first surface, and further comprising a plurality of spikes, each spike having a first end and a second end and being disposed in a corresponding one of said plurality of holes and being translatable between an extended position wherein said first end protrudes from said bottom surface of said sole and a retracted position wherein said first end does not protrude from said bottom surface of said sole, wherein each one of said plurality of spikes assumes its retracted position when said sole is in said first position and assumes its extended position when said sole is in said second position.

12. The footwear of claim 1 further comprising:

a lock pin fixed to said sole so as to have a portion thereof extending into said cavity; and first and second notches formed in said first surface of said slide member, said notches being arranged such that said first notch is aligned with said lock pin when said slide member is in said first position and said second notch is aligned with said lock pin when said slide member is in said second position.

13. The footwear of claim 1 wherein said spike is removable through said hole.

* * * * *